US005639269A

United States Patent [19]

Vanbesien et al.

[11] Patent Number: 5,639,269

[45] Date of Patent: Jun. 17, 1997

[54] PRESS-IN SPRING CLIP

[75] Inventors: Johan Vanbesien, Izegem; Jozef Meyfroidt, Ingelmunster; Johan Verhegghe, Oostkamp; Roger Schoubben, Zedelgem, all of Belgium

[73] Assignee: Siemens Aktiengesellschaft, Munich, Germany

[21] Appl. No.: 528,909

[22] Filed: Sep. 15, 1995

[30] Foreign Application Priority Data

Sep. 16, 1994 [DE] Germany ..... 9415079 U

[51] Int. Cl.[6] ..... H01R 13/415

[52] U.S. Cl. ..... 439/741; 439/943

[58] Field of Search ..... 439/741, 746, 439/743, 871, 872, 943, 870

[56] References Cited

U.S. PATENT DOCUMENTS

| | | | |
|---|---|---|---|
| 4,534,611 | 8/1985 | Wohlfart | 439/746 |
| 5,111,176 | 5/1992 | Lindquist | 439/622 |
| 5,112,233 | 5/1992 | Lybrand | 439/79 |
| 5,470,261 | 11/1995 | Embo et al. . | |

FOREIGN PATENT DOCUMENTS

| | | | |
|---|---|---|---|
| 2224413 | 1/1973 | Germany | 439/741 |
| 2505964 | 9/1975 | Germany | 439/741 |
| 4329151 | 3/1995 | Germany . | |
| 1073506 | 6/1967 | United Kingdom | 439/743 |
| 1209187 | 10/1970 | United Kingdom | 439/741 |

*Primary Examiner*—Neil Abrams
*Assistant Examiner*—T. C. Patel
*Attorney, Agent, or Firm*—Hill, Steadman & Simpson

[57] ABSTRACT

A spring clip is provided which may be inserted by a flat die pressing onto it from above. The spring clip includes an insulator body with a plurality of contact springs arranged in at least one row. Each contact spring has two press-in shoulders (8,9) in its terminal region. The contact springs can be inserted into a lower part (1) of the insulator body in press-in direction from above. Each respective terminal region is deformably twisted to a fixed angle relative to the remaining part of the contact spring such that the press-in shoulders (8,9) contact against press-in surfaces (10,11) fashioned in the lower part (1) of the insulator body.

8 Claims, 1 Drawing Sheet

PRESS-IN SPRING CLIP

BACKGROUND OF THE INVENTION

The present invention is generally directed to a press-in spring clip for pressing into bores of a printed circuit board. More particularly, the present invention is directed to a press-in spring clip having a plurality of contact springs, each being made of a sheet metal strip and having a contact part, a fastening section and a terminal region; the spring clip also having a two-part insulator body in which the contact springs are respectively arranged individually in chambers in at least one row and are secured such that insertable press-in parts project from the lower part of the insulator body.

The installation of such spring clips into the bores of a printed circuit board conventionally is performed by simultaneously plugging from above a pressure pin respectively into each spring contact from the contact part side opposite the circuit board and into the insulator body then, pressure is subsequently exerted, in a manner similar to plugging the spring clip to a blade connector. This conventional press-in technique is problematical since the non-plated pressure pins come into contact with the contact springs during press-in, whereby damage may occur due to the pressing power which can amount to up to 120N for a dependable contacting. Since spring clips typically have a larger plurality of poles, the press-in pressure members required for pressing look somewhat like a bed of nails. In view of the necessary precision and plurality of types that, of course, are required per number of poles, these press-in pressure members are complicated and cost-intensive tools, regardless of whether they are utilized in manual presses or automatic press-in units.

As background information, but not constituting prior art, German Patent Application, Ser. No. P 43 29 151.1, discloses a spring clip that can be pressed in with a flat die. Therein, a central, inner insulator body part is provided with noses at both sides that respectively engage into a recess provided in the fastening section of the contact springs. However, such a system is principally suited for spring clips having an arrangement of the contact springs in two rows.

SUMMARY OF THE INVENTION

An object of the present invention is to provide a press-in spring clip which may be easily assembled and which exhibits good force transmission through the contact spring press-in parts to the insulator body during insertion into a printed circuit board.

A further object of the present invention is to provide a press-in spring clip of the type initially described that can be pressed in with a flat die which is also suitable for contact springs arranged in three rows.

The objects of the invention are achieved by providing a spring clip with a cooperatively shaped body and contact springs such that the contact springs are positively supported near the press-in projection against the body during insertion of the projections into bores of a printed circuit board.

To this end, a press-in spring clip according to the present invention has an insulator body with an upper part and a lower part. A plurality of generally parallel chambers are formed in the insulator body. Each chamber is disposed through the upper and lower parts, and each chamber defines, in the lower body part, at least one press-in surface facing away from the upper part. A plurality of contact springs are provided, and each contact spring is held within a corresponding one of the chambers. Each contact spring includes: a contact part disposed generally within the upper part; a torsion region extending from the contact part; a press-in part projecting from the torsion region through the lower part; and at least one press-in shoulder formed by a widened portion of the contact spring at an upper end of the press-in part. According to the present invention, each contact spring is deformably twisted at the torsion region such that each press-in shoulder is positioned to contact against a corresponding one of the press-in surfaces to support the press-in parts against the insulator body. This supporting of the press-in parts along the press-in direction prevents transmission of the insertion force through the rest of the contact spring, thus preventing damage.

Preferably, the springs are each twisted at an angle between about 75° to 105°. The contact springs may be narrowed at the twisted region for easier twisting at the desired twist location, rather than twisting some other part of the contact spring.

Additional features and advantages of the present invention are described in, and will be apparent from the Figures and from the Detailed Description of the Presently Preferred Embodiments.

DETAINED DESCRIPTION OF THE PRESENTLY PREFERRED EMBODIMENTS

Figure 2:
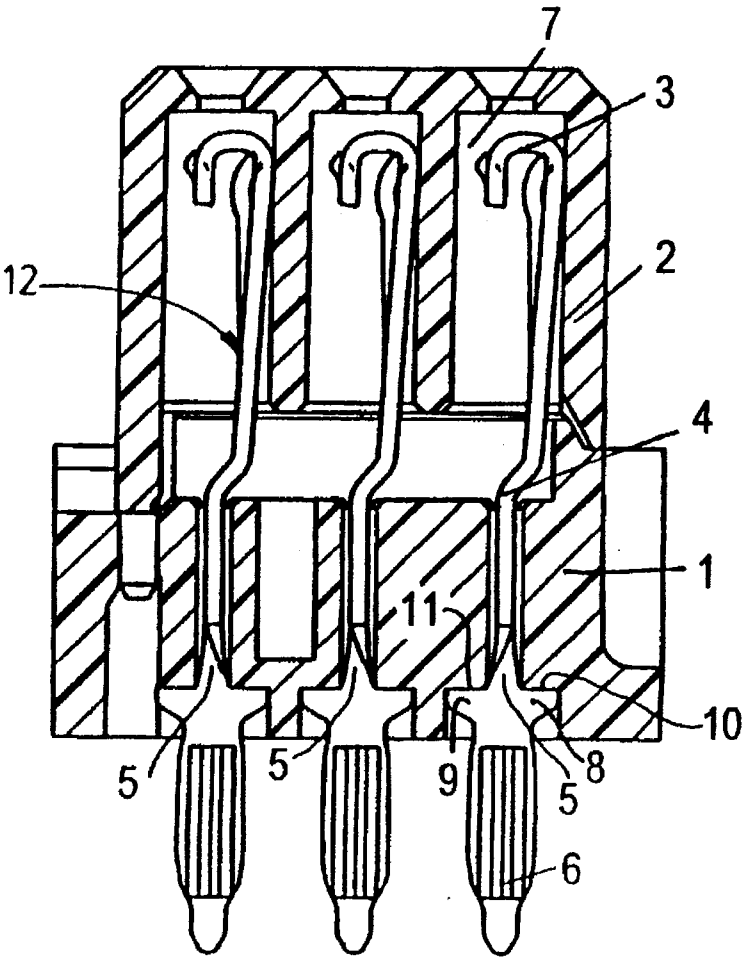
FIG. 2 is a sectional view onto the spring clip of FIG. 1 from an end face in its right-hand part.
Figure 1:
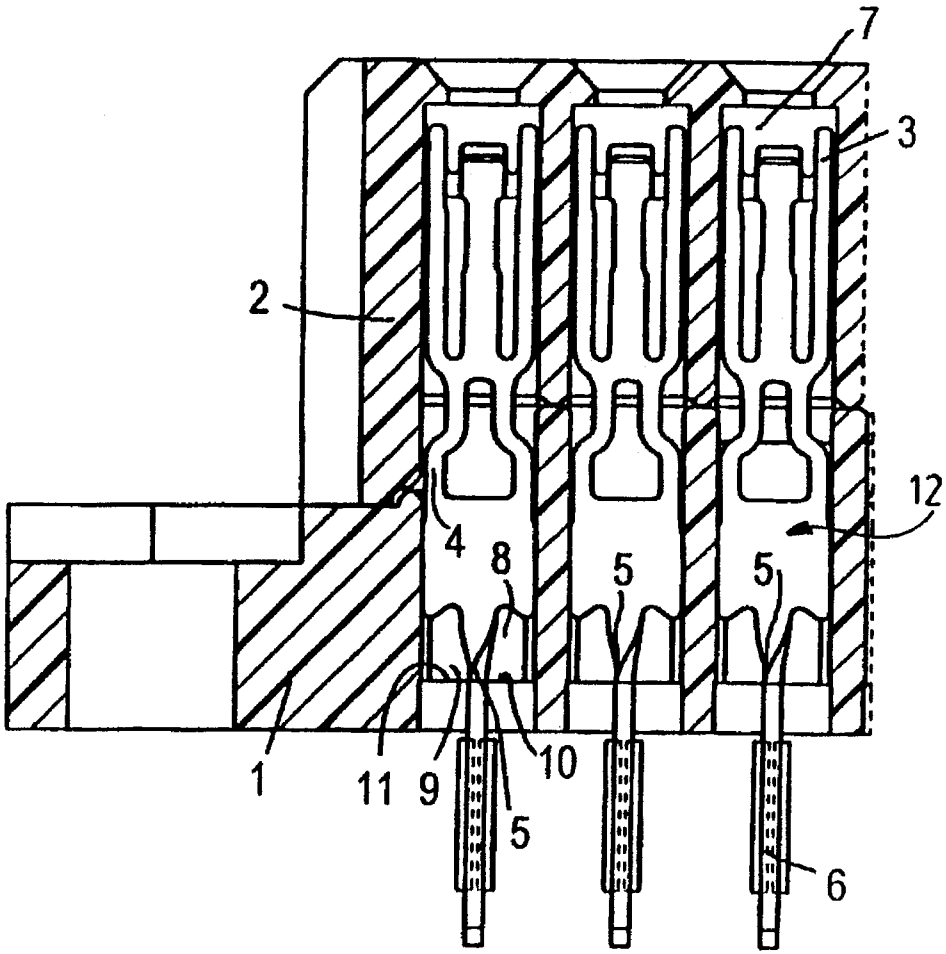
FIG. 1 is a sectional view onto a long side of the spring clip in its left-hand part.

FIGS. 1 and 2 illustrate an insulator body having a lower part 1 of the insulator body and of an upper part 2 of the insulator body defining contact chambers 7, each accepting one of a plurality of contact springs 12. The chambers are arranged side-by-side in at least one, and preferably three rows. The contact springs 12 each respectively include a contact part 3, a fastening section 4 and a terminal region having a press-in part 6. A torsion region 5 extends between the fastening sections 4 and the press-in part 6. A pair of opposing press-in shoulders 8 and 9 at an upper part of the terminal region of each contact spring may also be seen in the Figures, these press-in shoulders 8 and 9 respectively interact with and contact press-in surfaces 10 and 11 fashioned in the lower part 1 of the insulator body. The press-in surfaces 10 and 11 face away from the upper part 2, generally facing the direction of the press-in parts 6.

When pressing conventional plug-type connectors having press-in terminals into printed circuit boards, the desired shift to a press-in technique "via plastic", i.e. a press-in with a flat die that is pressed onto the insulator body of the plug-type connector from above, difficulties arise in achieving adequate transmission of the pressing power from the insulator body onto the contact springs. Accordingly, relatively large press-in shoulders have typically been required in order to have an adequate surface available for the transmission of the pressing power. The large press-in shoulders in turn cause a minimalization of the contact chambers so that the space required overall remains constant. The contact springs with such press-in shoulders, however, can no longer be inserted into the insulator body without further ado since the press-in shoulders strike against the walls of the contact chambers at the bottom.

A great advantage of the present invention is that, proceeding from that side of the lower part 1 of the insulator body facing toward the upper part 2 of the insulator body, the as yet untwisted contact springs can be inserted thereinto in press-in direction. The terminal regions can then be advantageously twisted with an angle of about respectively 75°–105°. It is advantageous for the deformation of the contact springs when these comprise a more narrowly implemented point in the torsion region 5.

During assembly, the contact springs are first inserted into the upper side of the lower part 1 of the insulator body in press-in direction, i.e. proceeding from above. Subsequently, the upper part 2 of the insulator body is put in place and latched. The contact springs 12 are then twisted, as described, positioning the shoulders 8, 9 on the respective press-in surfaces.

It should be understood that various changes and modifications to the presently preferred embodiments will be apparent to those skilled in the art. Such changes and modifications may be made without departing from the spirit and scope of the present invention and without diminishing its attendant advantages. Therefore, such changes and modifications are intended to be covered by the appended claims.

What is claimed is:

1. A press-in spring clip insertable into bores of a printed circuit board, the spring clip comprising:

a plurality of contact springs, each contact spring being made of a sheet metal strip and including a contact part, a fastening section and a terminal region, the terminal region having a torsion region, two press-in shoulders and a projecting press-in part; and a bipartite insulator body having an upper part and a lower part, a plurality of chambers being formed in the body, and each contact spring being respectively individually arranged in one of the chambers in at least one row and being secured therein such that the press-in parts project from a lower part of the insulator body, wherein each respective terminal region is twisted at the torsion region with a fixed angle relative to the remaining part of the contact spring such that the press-in shoulders contact against press-in surfaces fashioned in the lower part of the insulator body;

wherein the contact springs are insertable into the upper part of the insulator body in a press-in direction from a side of the lower part of the insulator body facing toward the upper part of the insulator body when the contact springs are in an untwisted state.

2. The press-in spring clip according to claim 1, wherein the terminal regions are each twisted between about 75° to 105°.

3. The press-in spring clip according to claim 1, wherein the contact springs narrow in the respective torsion regions.

4. The press-in spring clip according to claim 1 wherein the spring clip is a plug-type connector.

5. A press-in spring clip comprising:

an insulator body having an upper part and a lower part, a plurality of generally parallel chambers being formed in the insulator body, each chamber and being disposed through the upper and lower parts, each chamber defining, in the lower part, at least one press-in surface facing away from the upper part;

a plurality of contact springs, each contact spring being held within a corresponding one of the chambers, each contact spring including:

a contact part disposed generally within said upper part;

a torsion region extending from the contact part;

a press-in part projecting from the torsion region through the lower part; and at least one press-in shoulder formed by a widened portion of the contact spring at an upper end of the press-in part;

wherein each contact spring is deformably twisted at the torsion region such that each press-in shoulder contacts against a corresponding one of the press-in surfaces to support the press-in parts against the insulator body.

6. The press-in spring clip according to claim 5, wherein the torsion region is twisted between about 75 and 105.

7. The press-in spring clip according to claim 5, wherein there is a pair of oppositely disposed press-in shoulders on each contact spring.

8. The press-in spring clip according to claim 7, wherein there are two press-in surfaces corresponding to each chamber, each press-in surface supporting one of the press-in shoulders.

* * * * *